US009764936B2

(12) United States Patent
Wongsa

(10) Patent No.: US 9,764,936 B2
(45) Date of Patent: Sep. 19, 2017

(54) CHILLED BEVERAGE DISPENSER

(71) Applicant: Grindmaster Corporation, Louisville, KY (US)

(72) Inventor: Triyos Wongsa, Rayong (TH)

(73) Assignee: Grindmaster Corporation, Louisville, KY (US)

( * ) Notice: Subject to any disclaimer, the term of this patent is extended or adjusted under 35 U.S.C. 154(b) by 217 days.

(21) Appl. No.: 14/704,432

(22) Filed: May 5, 2015

(65) Prior Publication Data

US 2015/0315007 A1 Nov. 5, 2015

Related U.S. Application Data

(60) Provisional application No. 61/988,761, filed on May 5, 2014.

(51) Int. Cl.
*B67D 1/08* (2006.01)
*B67D 1/14* (2006.01)
(Continued)

(52) U.S. Cl.
CPC ..... *B67D 1/0859* (2013.01); *B01F 13/0827* (2013.01); *B67D 1/0801* (2013.01);
(Continued)

(58) Field of Classification Search
CPC .. B67D 1/0859; B67D 1/0801; B67D 1/0862; B67D 1/1477; B67D 2210/00031; B01F 13/0827; F25D 31/003
(Continued)

(56) References Cited

U.S. PATENT DOCUMENTS 3,060,702 A * 10/1962 Price, Jr. ..... B01F 13/0827 222/129
3,266,672 A * 8/1966 Dean ..... B67D 1/0858 222/129.1
(Continued)

FOREIGN PATENT DOCUMENTS

EP 0711726 B1 5/2000

OTHER PUBLICATIONS

Cecilware Corporation, "Arctic Series, Cold Beverage Dispensers" Marketing Brochure (undated).
(Continued)

*Primary Examiner* — Donnell Long
(74) *Attorney, Agent, or Firm* — Stites & Harbison, PLLC; David W. Nagle, Jr.; James R. Hayne

(57) ABSTRACT

A chilled beverage dispenser includes a lower housing, one or more bowls for storing a beverage positioned on the lower housing, and one or more locking members. Each locking member is rotatable between a first (closed) position, in which the locking member engages and prevents a bowl from being removed, and a second (open) position, in which the bowl may be readily removed from the lower housing. The chilled beverage dispenser may also include a bracket at the rear of the lower housing which engages a rear portion of a bowl, also preventing the bowl from being removed from the lower housing. The chilled beverage dispenser may also include a handle for engaging a dispensing valve, which is slidably removable from a cradle at the front of the bowl. The chilled beverage dispenser may also include a removable impeller cover and spray tube inside of the bowl.

18 Claims, 10 Drawing Sheets

(51) Int. Cl.
*F25D 31/00* (2006.01)
*B01F 13/08* (2006.01)

(52) U.S. Cl.
CPC ..... *B67D 1/0862* (2013.01); *B67D 1/1477* (2013.01); *F25D 31/003* (2013.01); *B67D 2210/00031* (2013.01)

(58) Field of Classification Search
USPC ..... 222/129.1, 146.6
See application file for complete search history.

(56) References Cited

U.S. PATENT DOCUMENTS 3,269,606 A * 8/1966 Armstrong ..... F25D 31/002 141/360
4,133,456 A 1/1979 Corini
4,505,409 A 3/1985 Armstrong
5,251,790 A * 10/1993 Cohn ..... B67D 1/06 222/146.6
7,140,196 B2 11/2006 Pfeifer et al.
8,141,754 B2 * 3/2012 Conner ..... B05B 9/007 222/333
8,215,511 B1 * 7/2012 Lin ..... B65D 39/08 215/228
2011/0139666 A1 6/2011 Sosnovsky et al.
2012/0055189 A1 3/2012 Sipp et al.

OTHER PUBLICATIONS

Grindmaster Corporation, "The Bubbler, Cratcho Classic Cold Beverage Dispensers" Marketing Brochure (2003).
Cecilware Corporation, "Arctic Deluxe Series" Operator's Manual (undated).
Grindmaster Corporation, "Beverage Dispensers," Service Manual (1996).
Grindmaster Corporation, "G-Cool Series, Crathco Beverage Dispensers" Operator's Manual (2007).
Grindmaster Corporation, "Crathco G-Cool, Innovative Cold Beverage Dispensers by Grindmaster" Marketing Brochure (2007).
Korean Intellectual Property Office, International Search Report and Written Opinion, from Corresponding International Application No. PCT/US2015/029257, dated Jul. 30, 2015.

* cited by examiner

CHILLED BEVERAGE DISPENSER

CROSS-REFERENCE TO RELATED APPLICATIONS

The present application claims priority to U.S. Patent Application Ser. No. 61/988,761 filed on May 5, 2014, the entire disclosure of which is incorporated herein by reference.

BACKGROUND OF THE INVENTION

The present invention relates to chilled beverage dispensers, i.e., beverage dispensers for cooling a beverage to an acceptable temperature for consumption, and then dispensing that beverage to a consumer. In this regard, there are various distinct types of chilled beverage dispensers in the industry. In most such beverage dispensers, the beverage is stored in a bowl, and the dispenser includes some form of cooling system for delivering a cooling medium to the beverage as stored in the bowl. For example, such a cooling system often includes a heat exchanger that is in contact with the beverage or the bowl. However, there are various cleaning and sanitation problems associated with such prior art constructions.

Thus, there remains a need for a chilled beverage dispenser that has components that can be readily installed and removed with minimal effort to facilitate cleaning of the bowls and/or other components.

SUMMARY OF THE INVENTION

The present invention is a chilled beverage dispenser that has multiple components that can be readily installed and removed with minimal effort. In particular, the chilled beverage dispenser of the present invention includes one or more bowls, dispenser assemblies, and agitator and spray units that can be readily installed and removed with minimal effort.

An exemplary chilled beverage dispenser made in accordance with the present invention comprises a lower housing with a front portion, a rear portion, and an upper surface. The lower housing further defines a compartment for housing various cooling components. The chilled beverage dispenser further includes one or more bowls for storing a beverage, each bowl having an open top that is covered by a removable lid. Furthermore, a dispensing assembly is installed in each bowl for dispensing the beverage from the bowl. Finally, the chilled beverage dispenser includes a locking assembly mounted at a front portion of the lower housing, which is configured to secure the bowl to the lower housing.

Each bowl is positioned on the upper surface of the lower housing with a front end of the bowl (i.e., the end of the bowl where the dispensing assembly is located) positioned adjacent to the front portion of the lower housing, and a rear end of the bowl positioned adjacent to the rear portion of the lower housing. The bowl defines an opening through its bottom surface, and this opening is configured such that, when the bowl is positioned on the upper surface of the lower housing, a heat exchange surface positioned on the upper surface of the lower housing is received within the opening, so that the beverage stored in the bowl is in contact with and cooled by the heat exchange surface. Furthermore, an impeller is preferably positioned adjacent to the heat exchange surface and configured to rotate in order to circulate the beverage within the bowl.

In some embodiments, a bracket is then connected to the rear portion of the lower housing adjacent to each bowl, and a flange extends outward from a rear surface of the bowl such that, when the bowl is positioned on the upper surface of the lower housing, the bracket engages the flange, thus preventing the rear portion of the bowl from moving upward and away from the upper surface of the lower housing.

In some embodiments, an exemplary locking assembly includes a locking member associated with each bowl that is operably connected to the lower housing, such that the locking member is capable of rotating about a substantially vertical pivot axis between a first (locked) position and a second (open) position. The locking assembly further includes a torsion spring that biases the locking member into the first (locked) position.

In some embodiments, the exemplary locking member has a first arm and a second arm, each of which extend away from a central pivot hole on opposite sides of the central pivot hole. In the first (locked) position, the first arm of the locking member engages a catch extending from the bottom surface of the bowl, thus locking down the bowl adjacent to the upper surface of the lower housing. In some embodiments, the first arm of the locking member terminates in a retaining portion, which has a lower surface and defines a central channel. The catch then includes a downwardly projecting shaft terminating in an enlarged distal end. In this way, when the locking member is in the first (locked) position, the shaft of the catch extends through the central channel of the retaining portion, and the enlarged distal end of the catch is positioned with an upper surface of the enlarged distal end adjacent to the lower surface of the retaining portion. Because the locking member is operably connected to the lower housing, the retaining portion of the first arm of the locking member prevents the front portion of the bowl from moving upward and away from the lower housing. In the second (open) position, the locking member is rotated so that the first arm of the locking member does not engage the catch of the bowl and, therefore, the front portion of the bowl is capable of moving upward and away from the lower housing.

In some embodiments, the second arm of the locking member extends from the pivot hole away from the first arm and terminates in an engagement surface. When a force is applied to the engagement surface, the locking member rotates from the first (locked) position to the second (open) position. When the force is no longer applied to the engagement surface, the biasing force of the torsion spring returns the locking member to the first (locked) position. In this way, the second arm effectively serves as a handle for the movement of the locking member between the first (locked) position and the second (open) position.

In some embodiments, the chilled beverage dispenser comprises a first bowl and a second bowl, and in these embodiments, the exemplary locking assembly may further include a central member operably connected to the front portion of the lower housing, the central member having a first end and a second end opposite the first end. The locking assembly then includes a first locking member and a second locking member operably connected to the central member at each of the respective first and second ends of the central member, such that each locking member is capable of rotating about a respective vertical pivot axis between a first (locked) position and a second (open) position. The first locking member is associated with the first bowl, and the second locking member is associated with the second bowl.

In practice, to install a bowl on the upper surface of the lower housing of an exemplary beverage dispenser made in accordance with the present invention, the bowl is advanced toward the rear of the chilled beverage dispenser at a slight angle, such that the flange extending outward from the rear surface of the bowl slides under the bracket that is connected to the rear portion of the lower housing. The bowl is then rotated downward relative to the upper surface of the lower housing, such that the bracket engages the flange. At this point, the heat exchange surface extends through the opening defined through the bottom surface of the bowl and into the volume enclosed by the bowl. In this regard, a sealing gasket is preferably used to prevent any leakage of beverage through the opening. Furthermore, as the bowl is rotated into position against the upper surface of the lower housing, the associated locking member, through manipulation of the second arm of the locking member, is pivoted into the second (open) position. Once the bowl has been rotated downward onto the upper surface of the lower housing, the second arm of the locking member is released, and the locking member is returned, by the biasing force of the torsion spring, to the first (locked) position in which the first arm of the locking member engages and retains the catch of the bowl, locking the bowl onto the lower housing. In other words, the downwardly projecting shaft of the catch extends through the central channel of the retaining portion at the end of the first arm of the locking member. The enlarged distal end of the catch is adjacent to the lower surface of the retaining portion at the end of the first arm of the locking member, thus preventing the bowl from rotating upward.

To remove the bowl, the locking member is again pivoted from the first (locked) position to the second (open) position through manipulation of the second arm of the locking member. While the locking member is maintained in the second (open) position, the front of the bowl is rotated upward, and the bowl is then pulled forward to disengage the flange at the rear of the bowl from the bracket at the rear portion of the lower housing.

With regard to the dispenser assemblies, in some embodiments, the bowl also defines a dispenser opening and includes a cradle positioned at the front portion of the bowl. An exemplary dispensing assembly includes a dispensing valve which is seated in the dispenser opening defined by the bowl and includes a circumferential flange. The exemplary dispensing assembly further includes a handle that engages the valve, exterior to the bowl; however, there is no rigid connection between the handle and the valve or the bowl. Rather, the handle simply slides onto and engages the cradle positioned at the front portion of the bowl. Specifically, in some embodiments, the cradle preferably includes two support members that extend downward from the bottom surface of the bowl on either side of the valve, with each support member including a lateral projection. The handle includes a vertical engagement plate connected to a horizontal support plate, which slidably engages the cradle.

The horizontal support plate of the handle further defines a central slot such that, when the handle is slid onto the cradle, the valve is received in the central slot with the circumferential flange of the valve positioned above the horizontal support plate. When the vertical engagement plate of the handle is pushed by a user, the horizontal support plate of the handle pivots about a forward portion of the lateral projections of the cradle, such that the horizontal support plate of the handle applies an upward force on the circumferential flange of the valve. This pushes the valve into the upward (open) position, thus allowing the beverage to be dispensed through the valve to the exterior of the first bowl. Again, however, there is no rigid connection between the handle and the valve or the bowl. Therefore, the handle can be readily disconnected from the valve and the bowl, for example, for cleaning.

As a further refinement, in some embodiments, the chilled beverage dispenser additionally has an agitator and spray unit comprised of a removable impeller cover and a spray tube for use within the bowl. Specifically, the chilled beverage dispenser has an impeller positioned adjacent to the heat exchange surface which rotates in order to circulate the beverage within the bowl to more uniformly cool the beverage stored in the bowl. The impeller cover is constructed and configured to be placed over the impeller, with the periphery of the impeller cover effectively coextensive with the periphery of the heat exchange surface. The impeller cover is not attached to the heat exchange surface, but rather it is attached to the bowl. Advantageously, the bowl of the chilled beverage dispenser thus is still removable from the lower housing in the manner described above regardless of whether the impeller cover is attached to the bowl. In any event, due to the installation of such an impeller cover and spray tube, the impeller draws the beverage into an intake hole in the impeller cover and then pushes the beverage out of a nozzle at the top of the spray tube, thus creating a visually appealing display in addition to circulating the beverage.

Finally, it should be recognized that a chilled beverage dispenser made in accordance with the present invention includes a typical cooling system to produce the necessary refrigeration circuit. For example, evaporator coils may be positioned within the heat exchange surface and placed in fluid communication with certain cooling components housed in a lower housing of the chilled beverage dispenser. The cooling components may include a compressor, a condenser, a filter/dryer, an expansion valve (or other refrigerant control device), a suction accumulator, and a suction line. As is common in such cooling systems, the compressor compresses the cooling medium, preferably a refrigerant gas such as R404a (a commercially available hydrofluorocarbon refrigerant), to raise the temperature and stored energy of the cooling medium. Therefore, the cooling medium exits the compressor and enters the condenser as a hot, high pressure gas. In the condenser, the heat from the pressurization of the cooling medium is dissipated, and the cooling medium reverts to a liquid form, but remains at a high pressure. The cooling medium then passes through a filter drier, which is designed to filter out contaminants and dry the cooling medium to prevent ice formation. As it exits the filter drier, the cooling medium passes through an expansion valve, which serves as a pressure-reducing device and meters the cooling medium into the evaporator coils of the heat exchange surface. Because of the pressure drop, the cooling medium evaporates, absorbing heat as it does so. By the time the cooling medium exits the evaporator coils, returning to the compressor through a suction accumulator and associated suction line, it again is a cool, low-pressure gas.

DETAILED DESCRIPTION OF THE INVENTION

The present invention is a chilled beverage dispenser that has multiple components that can be readily installed and removed with minimal effort. In particular, the chilled beverage dispenser of the present invention includes bowls, dispenser assemblies, and agitator and spray units that can be readily installed and removed with minimal effort.

Figure 1:
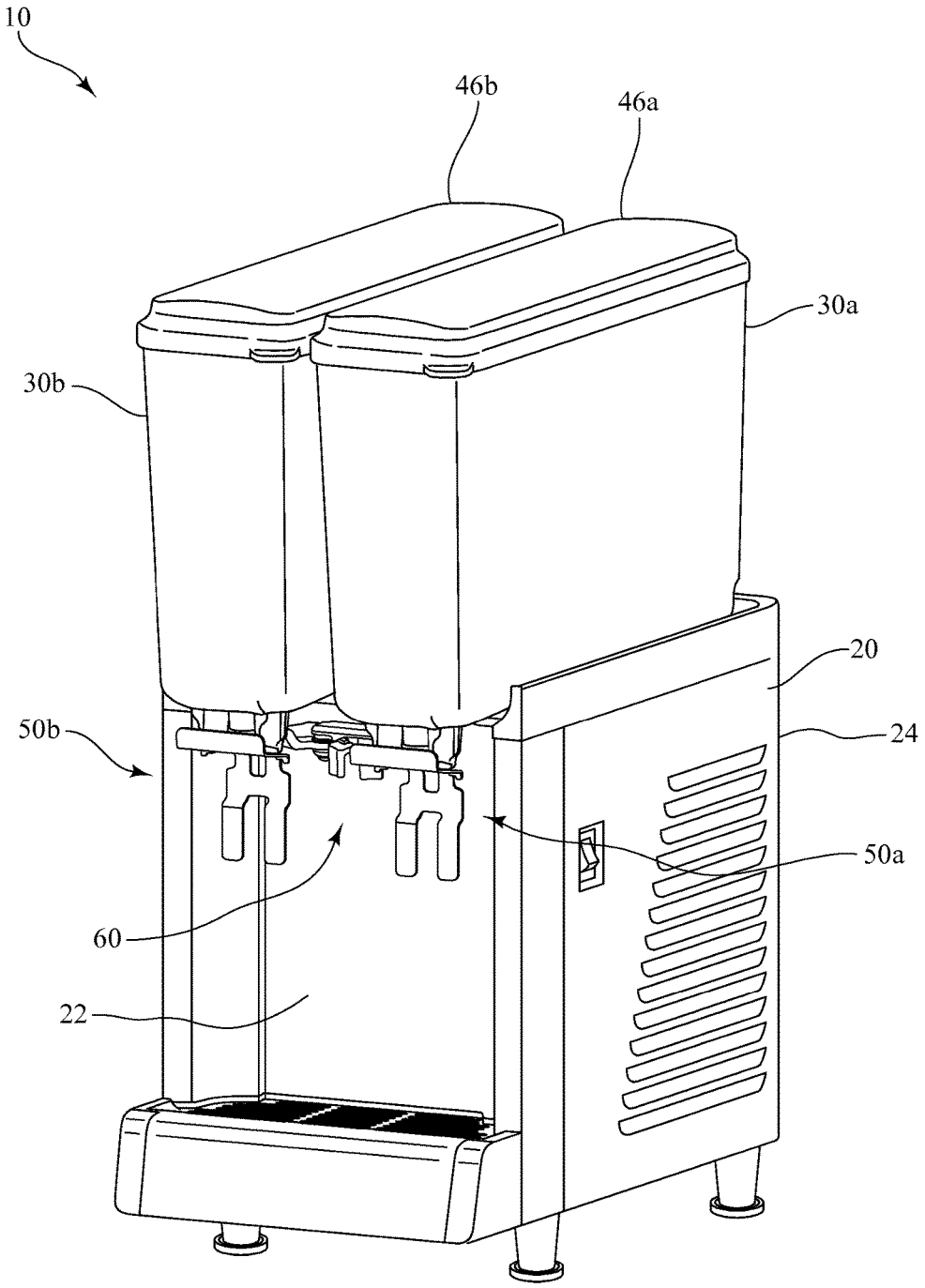
FIG. 1 is a front perspective view of an exemplary chilled beverage dispenser made in accordance with the present invention.
Figure 2:
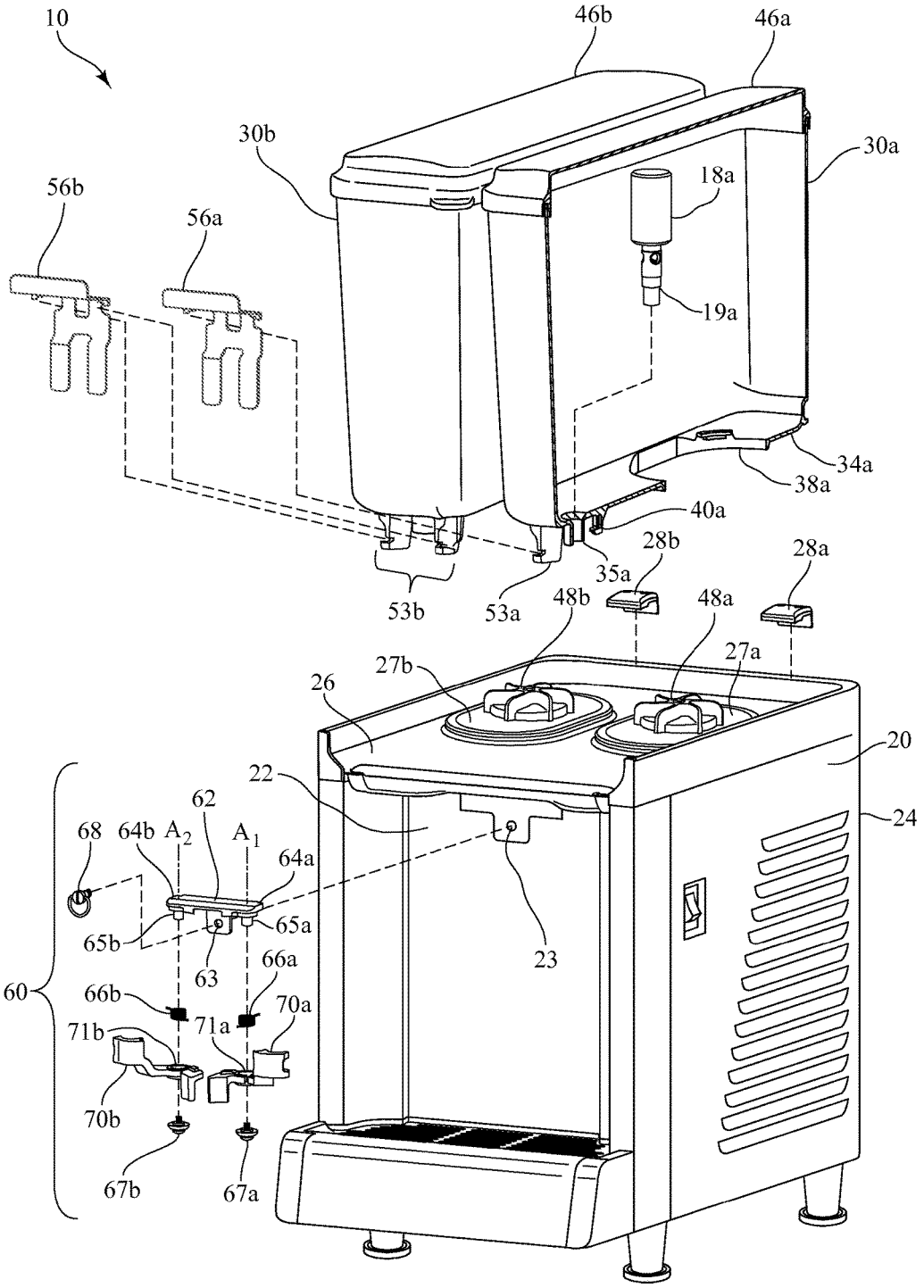
FIG. 2 is an exploded view of the exemplary chilled beverage dispenser of FIG. 1, with a first bowl and first lid partially cut away to show the interior of the first bowl.

Referring first to FIGS. 1 and 2, an exemplary chilled beverage dispenser 10 made in accordance with the present invention comprises a lower housing 20 with a front portion 22, a rear portion 24, and an upper surface 26. The lower housing 20 further defines a compartment for housing various cooling components, as further described below. In this exemplary embodiment, the chilled beverage dispenser 10 further includes a first bowl 30*a* for storing a first beverage and a second bowl 30*b* for storing a second beverage. Each of the two bowls 30*a*, 30*b* has an open top that is covered by a removable lid 46*a*, 46*b*. Furthermore, a dispensing assembly 50*a*, 50*b* is installed in each bowl 30*a*, 30*b*, as further described below. Finally, the chilled beverage dispenser 10 includes a locking assembly 60 mounted at a front portion 22 of the lower housing 20, which is configured to secure the first and second bowls 30*a*, 30*b* to the lower housing 20, as further described below.

The first and second bowls 30*a*, 30*b* are positioned on the upper surface 26 of the lower housing 20 with a front end of each bowl 30*a*, 30*b* (i.e., the end of the bowl where the dispensing assembly 50*a*, 50*b* is located) positioned adjacent to the front portion 22 of the lower housing 20, and a rear end of each bowl 30*a*, 30*b* positioned adjacent to the rear portion 24 of the lower housing 20. First and second heat exchange surfaces 27*a*, 27*b* are positioned on the upper surface 26 of the lower housing 20 and are connected to a means for supplying a cooling medium, as further described below. As shown in FIG. 2, the first bowl 30*a* defines an opening 38*a* through its bottom surface 34*a*, and this opening 38*a* is configured such that, when the first bowl 30*a* is positioned on the upper surface 26 of the lower housing 20, the first heat exchange surface 27*a* is received within the opening 38*a*, so that the beverage stored in the first bowl 30*a* is in contact with and cooled by the first heat exchange surface 27*a*. Similarly, although not shown in the Figures, the second bowl 30*b* defines an identical opening in its bottom surface, and this opening is configured such that, when the second bowl 30*b* is positioned on the upper surface 26 of the lower housing 20, the second heat exchange surface 27*b* is received within the opening.

Referring still to FIGS. 1 and 2, a first impeller 48*a* is positioned adjacent to the first heat exchange surface 27*a*, and a second impeller 48*b* is positioned adjacent to the second heat exchange surface 27*b*. The impellers 48*a*, 48*b* are configured to rotate in order to circulate the beverage within the respective bowls 30*a*, 30*b* and more uniformly cool the beverage stored in the respective bowls 30*a*, 30*b*. In this exemplary embodiment, the impellers 48*a*, 48*b* are magnetically coupled to a drive (not shown) interior to the lower housing 20. Of course, other mixing and circulation mechanisms, such as pumps, could also be used in the exemplary chilled beverage dispenser 10 without departing from the spirit and scope of the present invention.

Figure 3:
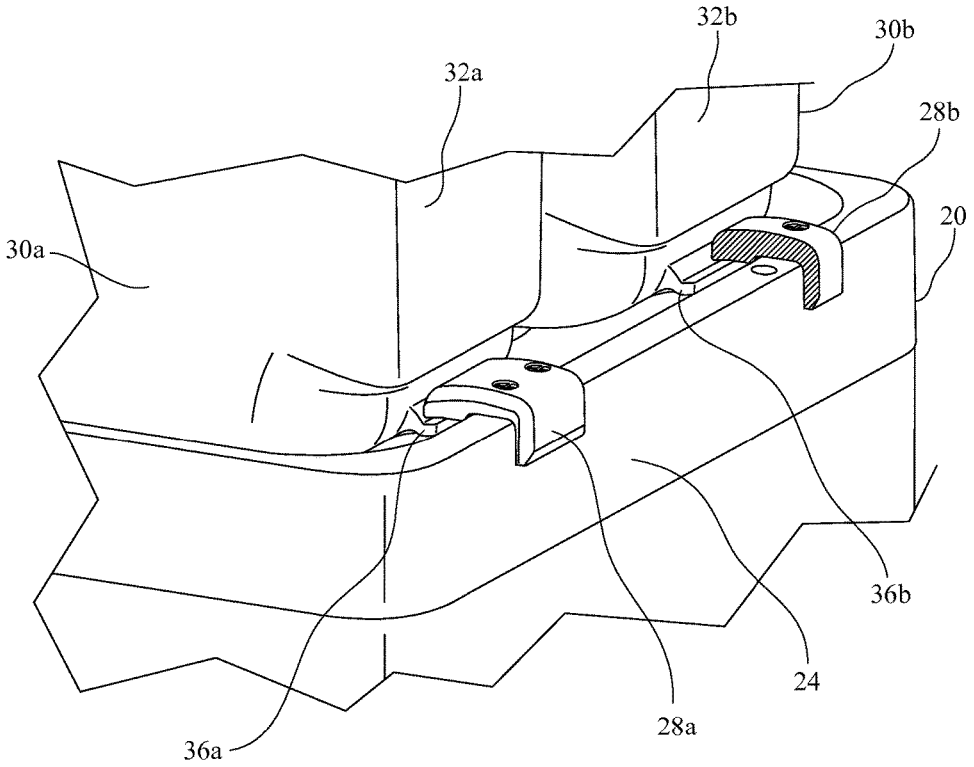
FIG. 3 is a partial rear perspective view of the exemplary chilled beverage dispenser of FIG. 1, with one of the brackets partially cut away.

Referring now to FIGS. 2 and 3, a first bracket 28*a* is connected to the rear portion 24 of the lower housing 20 adjacent to the first bowl 30*a*. As best shown in FIG. 3, a first flange 36*a* extends outward from a rear surface 32*a* of the first bowl 30*a* such that, when the first bowl 30*a* is positioned on the upper surface 26 of the lower housing 20, the first bracket 28*a* engages the first flange 36*a*, thus preventing the rear portion of the first bowl 30*a* from moving upward and away from the upper surface 26 of the lower housing 20. Similarly, a second bracket 28*b* is connected to the rear portion 24 of the lower housing 20 adjacent to the second bowl 30*b*, and a second flange 36*b* extends outward from a rear surface 32*b* of the second bowl 30*b* such that, when the second bowl 30*b* is positioned on the upper surface 26 of the lower housing 20, the second bracket 28*b* engages the second flange 36*b*, thus preventing the rear portion of the second bowl 30*b* from moving upward and away from the upper surface 26 of the lower housing 20.

Referring once again to FIG. 2, in this exemplary embodiment, the locking assembly 60 includes a central member 62 operably connected to the front portion 22 of the lower housing 20. The central member 62 has a first end 64*a* and a second end 64*b* opposite the first end 64*a*, with a shaft 65*a*, 65*b* extending downward from each of the first and second ends 64*a*, 64*b* of the central member 62. The locking assembly 60 further includes a first locking member 70*a* and a second locking member 70*b*, each of which is operably connected to the central member 62 at the respective first and second ends 64*a*, 64*b* of the central member 62, such that each locking member 70*a*, 70*b* is configured for rotation about a respective vertical pivot axis A1, A2 between a first (locked) position and a second (open) position. In this exemplary embodiment, the first locking member 70*a* is associated with the first bowl 30*a*, and the second locking member 70*b* is associated with the second bowl 30*b*, as further described below.

In this exemplary embodiment, the locking assembly 60 further includes first and second torsion springs 66*a*, 66*b*, each of which biases a respective locking member 70*a*, 70*b* into the first (locked) position. In this regard, a torsion spring 66*a*, 66*b* is positioned around each of the shafts 65*a*, 65*b* at the first and second ends 64*a*, 64*b* of the central member 62. Each locking member 70*a*, 70*b* defines a central pivot hole 71*a*, 71*b*, such that the torsion springs 66*a*, 66*b* and the shafts 65*a*, 65*b* are both positioned within the central pivot hole 71*a*, 71*b* of the respective locking member 70*a*, 70*b*. A retaining screw 67*a*, 67*b* is then screwed into the shafts 65*a*, 65*b* of the central member 62, thus preventing the respective locking members 70*a*, 70*b* from sliding off of the shaft 65*a*, 65*b*, but still allowing each locking member 70*a*, 70*b* to rotate about and relative to the respective shaft 65*a*, 65*b* at each of the first and second ends 64*a*, 64*b* of the central member 62. As such, the first shaft 65*a*, the first torsion spring 66*a*, the central pivot hole 71*a* of the first locking member 70*a*, and the first retaining screw 67*a* are aligned along the first vertical pivot axis A1. Similarly, the second shaft 65*b*, the second torsion spring 66*b*, the central pivot hole 71*b* of the second locking member 70*b*, and the second retaining screw 67*b* are aligned along the second vertical pivot axis A2.

As shown in FIG. 2, in this exemplary embodiment, the locking assembly 60 further includes a quick-release fastener 68 which operably connects the central member 62 to the front portion 22 of the lower housing 20. One exemplary quick-release fastener for use with the present invention is a D3-DZUS® PANEX Quarter-Turn Fastener manufactured and distributed by Southco, Inc. of Concordville, Pa. Specifically, the central member 62 of the locking assembly 60 defines a pin hole 63, and the front portion 22 of the lower housing 20 defines a corresponding pin hole 23 such that, when the pin hole 63 of the central member 62 and the respective pin hole 23 of the lower housing 20 are placed in registry with one another, the quick-release fastener 68 is inserted through the pin hole 63 of the central member 62 and the corresponding pin hole 23 of the lower housing 20. After insertion, turning the quick-release fastener 68 one-quarter turn locks the quick-release fastener 68 in place and mounts the central member 62 of the locking assembly 60 to the front portion 22 of the lower housing 20.

Figure 4:
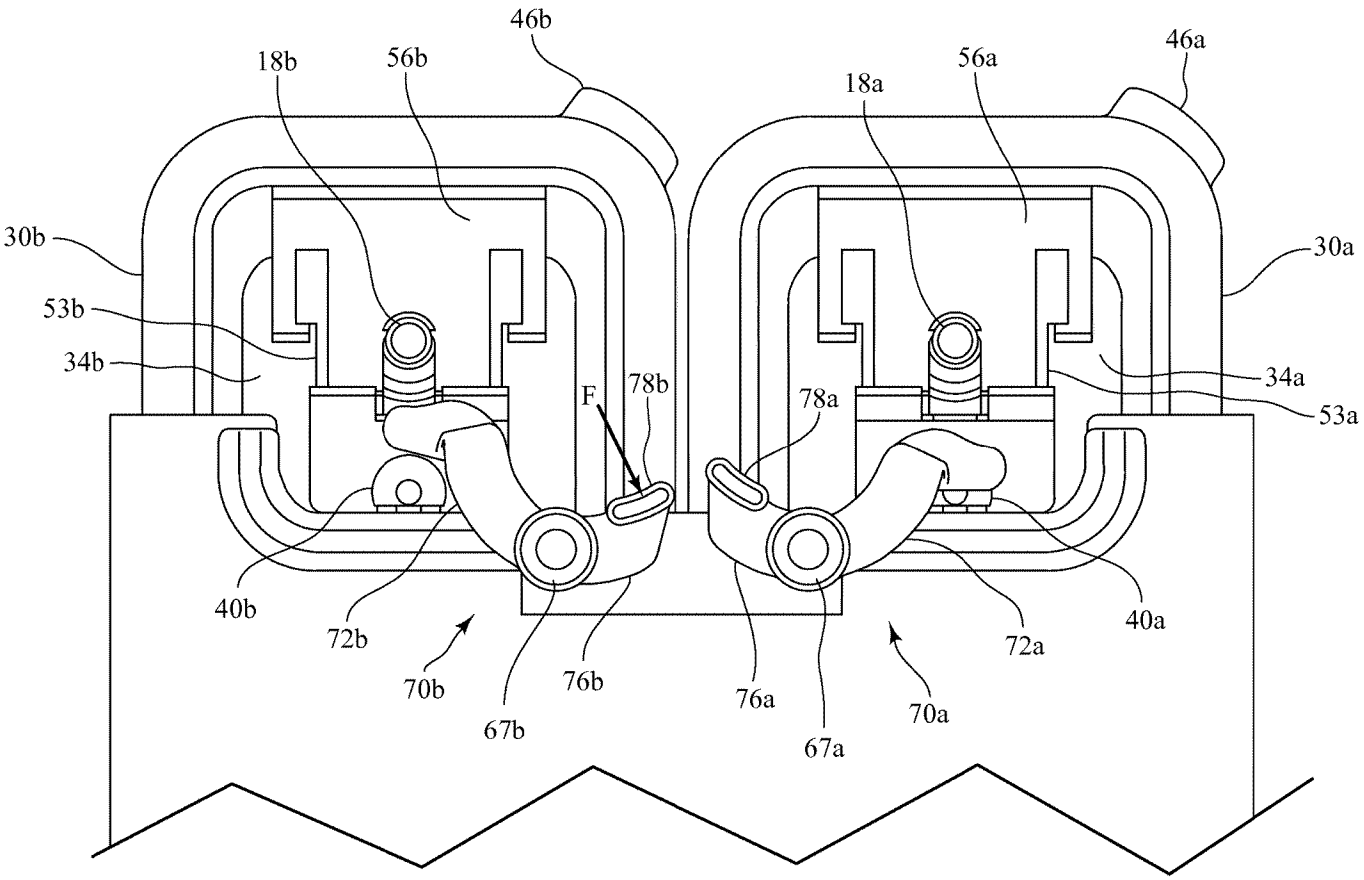
FIG. 4 is a partial bottom view of the exemplary chilled beverage dispenser of FIG. 1, with portions removed to more clearly show a first locking member in a first (locked) position and a second locking member in a second (open) position.

FIG. 4 is a partial bottom view of the exemplary chilled beverage dispenser 10, which shows the first locking member 70*a* in the first (locked) position and the second locking member 70*b* in the second (open) position. Each of the locking members 70*a*, 70*b* has a first arm 72*a*, 72*b* and a second arm 76*a*, 76*b* which extend away from the central pivot hole 71*a*, 71*b* (which is behind the retaining screw 67*a*, 67*b* in FIG. 4) on opposite sides of the central pivot hole 71*a*, 71*b*.

Referring still to FIG. 4, as discussed above, each of the locking members 70*a*, 70*b* is rotatable between a first (locked) position and a second (open) position. In FIG. 4, the first locking member 70*a* is in the first (locked) position, with the first arm 72*a* of the first locking member 70*a* engaging a catch 40*a* (see also FIG. 2) extending from the bottom surface 34*a* of the first bowl 30*a*, thus locking down the first bowl 30*a* adjacent to the upper surface 26 of the lower housing 20. In FIG. 4, the second locking member 70*b* is in the second (open) position. Specifically, the second locking member 70*b* has been rotated so that the first arm 72*b* of the second locking member 70*b* does not engage a catch 40*b* of the second bowl 30*b* and, therefore, the front portion of the second bowl 30*b* is capable of moving upward and away from the lower housing 20.

Referring still to FIG. 4, in this exemplary embodiment, the second locking member 70*b* is identical to (but essentially a mirror image of) the first locking member 70*a*. As such, the second locking member 70*b* is able to lock the second bowl 30*b* in the same manner as described above with reference to the first locking member 70*a* and first bowl 30*a*. Likewise, the first locking member 70*a* is able to rotate to allow the first bowl 30*a* to be moved upward and away from the lower housing 20.

Figure 5:
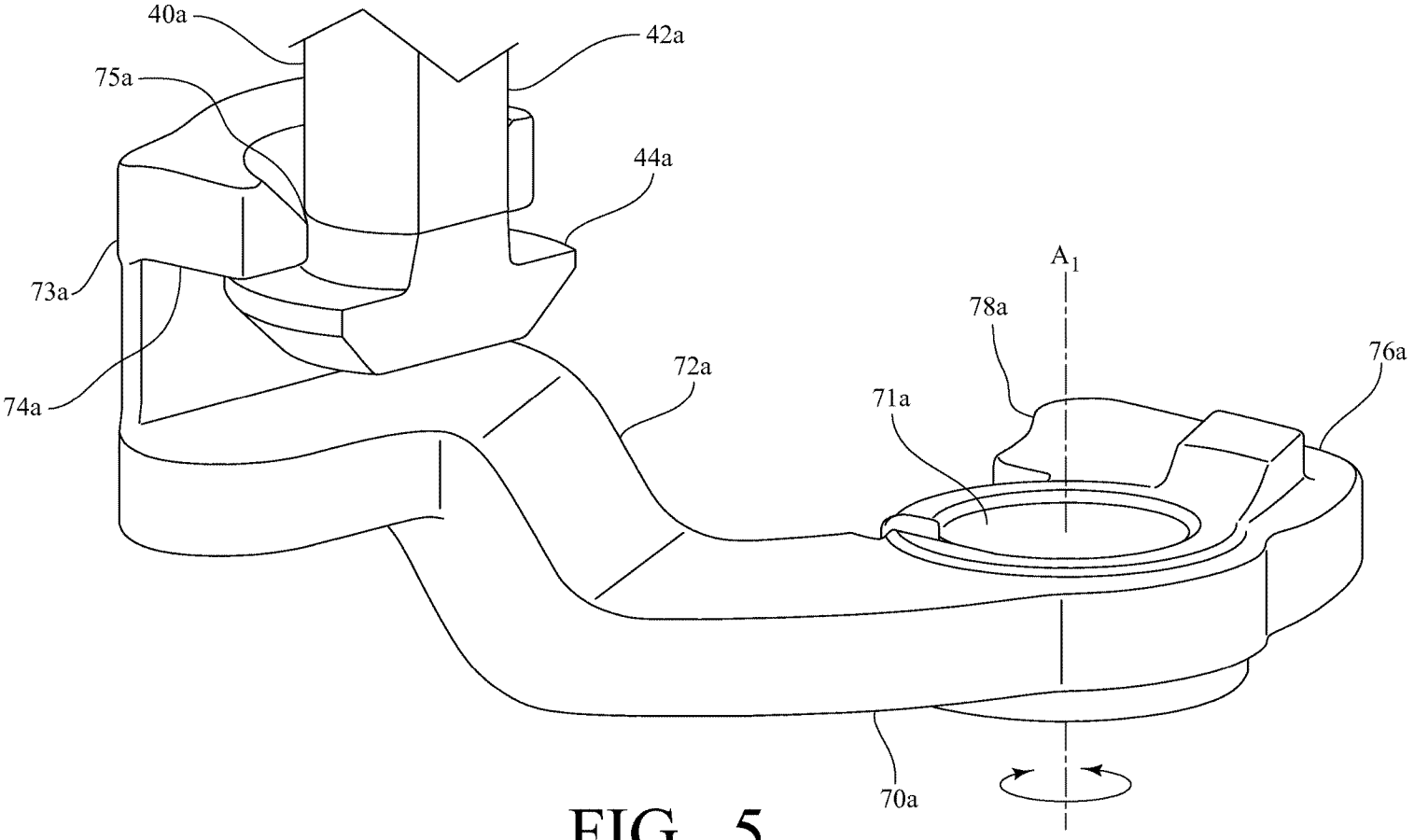
FIG. 5 is an enlarged view of the first locking member engaging a catch that extends downward from the bottom of the first bowl of the exemplary chilled beverage dispenser of FIG. 1.

FIG. 5 is an enlarged view of the first locking member 70*a* engaging the catch 40*a* that extends downward from the bottom of the first bowl 30*a*. As shown, the first arm 72*a* of the first locking member 70*a* includes a retaining portion 73*a*, which defines a lower surface 74*a* and a central channel 75*a*. The catch 40*a* includes a downwardly projecting shaft 42*a* terminating in an enlarged distal end 44*a*. In this way, when the first locking member 70*a* is in the first (locked) position, the downwardly projecting shaft 42*a* of the catch 40*a* extends through the central channel 75*a* defined by retaining portion 73*a*, and the enlarged distal end 44*a* of the catch 40*a* is positioned with an upper surface of the enlarged distal end 44*a* adjacent to the lower surface 74*a* defined by the retaining portion 73*a*. Because the first locking member 70*a* is operably connected to the lower housing 20 by way of the central member 62 (as discussed above), the retaining portion 73*a* of the first arm 72*a* of the first locking member 70*a* prevents the front portion of the first bowl 30*a* from moving upward and away from the lower housing 20.

Referring now to FIGS. 4 and 5, the second arm 76*a* of the first locking member 70*a* extends from the central pivot hole 71*a* away from the first arm 72*a* and terminates in an engagement surface 78*a*. When a force F (shown applied to the second locking member 70*b* in FIG. 4) is applied to the engagement surface 78*a*, the first locking member 70*a* rotates from the first (locked) position to the second (open) position. After the force is no longer applied to the engagement surface 78*a*, the biasing force of the first torsion spring 66*a* returns the first locking member 70*a* to the first (locked) position. In this way, the second arm 76*a* effectively serves as a handle for the movement of the first locking member 70*a* between the first (locked) position and the second (open) position. The second locking member 70*b* operates in exactly the same manner as the first locking member 70*a* with respect to a catch 40*b* (FIG. 4) of the second bowl 30*b*.

In practice, to install the first bowl 30*a* (or any other bowl) on the upper surface 26 of the lower housing 20, the first bowl 30*a* is advanced toward the rear of the chilled beverage dispenser 10 at a slight angle, such that the first flange 36*a* extending outward from the rear surface 32*a* of the first bowl 30*a* slides under the first bracket 28*a* that is connected to the rear portion 24 of the lower housing 20. The first bowl 30*a* is then rotated downward relative to the upper surface 26 of the lower housing 20, such that the first bracket 28*a* engages the first flange 36*a*. At this point, the first heat exchange surface 27*a* extends through the opening 38*a* defined through the bottom surface 34*a* of the first bowl 30*a* and into the volume enclosed by the first bowl 30*a*. In this regard, a sealing gasket (not shown) is preferably used to prevent any leakage of beverage through the opening 38*a*. Furthermore, as the first bowl 30*a* is rotated into position against the upper surface 26 of the lower housing 20, the first locking member 70*a*, through manipulation of the second arm 76*a* of the first locking member 70*a*, is pivoted into the second (open) position. Once the first bowl 30*a* has been rotated downward onto the upper surface 26 of the lower housing 20, the second arm 76*a* of the first locking member 70*a* is released, and the first locking member 70*a* is returned, by the biasing force of the first torsion spring 66*a*, to the first (locked) position in which the first arm 72*a* of the first locking member 70*a* engages and retains the catch 40*a* of the first bowl 30*a*, locking the first bowl 30*a* onto the lower housing 20. In other words, the downwardly projecting shaft 42*a* of the catch 40*a* extends through the central channel 75*a* defined by the retaining portion 73*a* at the end of the first arm 72*a* of the first locking member 70*a*. The enlarged distal end 44*a* of the catch 40*a* is adjacent to the lower surface 74*a* defined by the retaining portion 73*a* at the end of the first arm 72*a* of the first locking member 70*a*, thus preventing the first bowl 30*a* from moving upward, as previously discussed above.

To then remove the first bowl 30*a*, the first locking member 70*a* is again pivoted from the first (locked) position to the second (open) position through manipulation of the second arm 76*a* of the first locking member 70*a*. While the first locking member 70*a* is maintained in the second (open) position, the front of the first bowl 30*a* is rotated upward, and the first bowl 30*a* is then pulled forward to disengage the first flange 36*a* at the rear of the first bowl 30*a* from the first bracket 28*a* at the rear portion 24 of the lower housing 20.

The second bowl 30*b* is installed and removed through manipulation of the second locking member 70*b* and the second bowl 30*b* in exactly the same manner. As a result of such a construction, each bowl 30*a*, 30*b* can be readily installed and removed with minimal effort. For example, the bowls 30*a*, 30*b* can be quickly and easily removed for cleaning.

Figure 6:
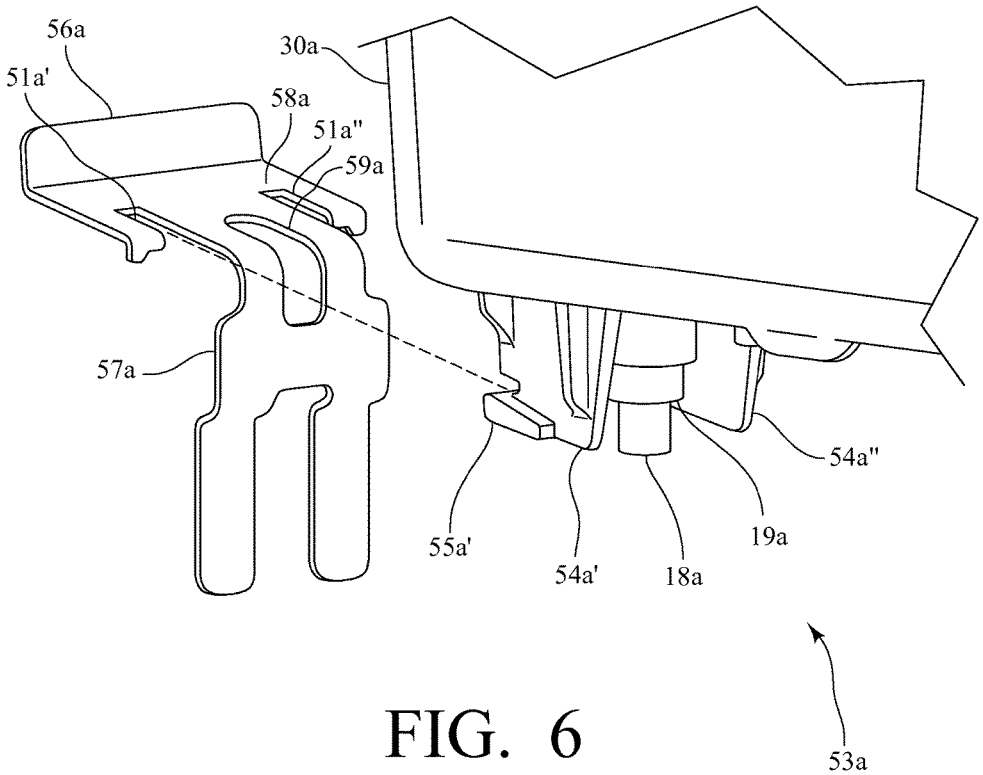
FIG. 6 is an enlarged view showing the interaction of a first handle and the first bowl.

With regard to the dispenser assemblies 50*a*, 50*b*, and referring now to FIGS. 2 and 6, the first bowl 30*a* also defines a dispenser opening 35*a* and includes a cradle 53*a* positioned at the front portion of the first bowl 30*a*, the function of which is further described below. The exemplary first dispensing assembly 50*a* includes a first dispensing valve 18*a* which is seated in the dispenser opening 35*a* defined by the first bowl 30*a* and includes a circumferential flange 19*a*. The exemplary first dispensing assembly 50*a* further includes a first handle 56*a* that engages the first valve 18*a* exterior to the first bowl 30*a*; however, as shown in FIGS. 2 and 6, there is no rigid connection between the first handle 56*a* and the first valve 18*a* or the first bowl 30*a*. Rather, the first handle 56*a* simply slides onto and engages the cradle 53*a*. Specifically, and as perhaps best shown in FIG. 6, the cradle 53*a* includes two support members 54*a*', 54*a*" that extend downward from the bottom surface 34*a* of the first bowl 30*a* on either side of the first valve 18*a*, with each support member 54*a*', 54" including a lateral projection 55*a*' (only one of which is viewable in FIG. 6). The first handle 56*a* includes a vertical engagement plate 57*a* connected to a horizontal support plate 58*a*, which slidably engages the cradle 53*a*. Specifically, the horizontal support plate 58*a* defines two parallel slits 51*a*', 51*a*" which are configured to accept the two support members 54*a*', 54*a*", while the horizontal support plate 58*a* rests on the lateral projections 55*a*' (only one of which is viewable in FIG. 6). Of course, other means of attaching the first handle 56*a* to the cradle 53*a* may also be used without departing from the spirit and scope of the present invention.

The horizontal support plate 58*a* of the first handle 56*a* further defines a central slot 59*a* such that, when the first handle 56*a* is slid onto the cradle 53*a*, the first valve 18*a* is received in the central slot 59*a*, with the circumferential flange 19*a* of the first valve 18*a* positioned above the horizontal support plate 58*a*. When the vertical engagement plate 57*a* of the first handle 56*a* is pushed by a user, the horizontal support plate 58*a* of the first handle 56*a* pivots about a forward portion of the lateral projections 55*a*' of the cradle 53*a*, such that the horizontal support plate 58*a* of the first handle 56*a* applies an upward force on the circumferential flange 19*a* of the first valve 18*a*. This pushes the first valve 18*a* into the upward (open) position, thus allowing the beverage to be dispensed through the first valve 18*a* to the exterior of the first bowl 30*a*. Again, however, there is no rigid connection between the first handle 56*a* and the first valve 18*a* or the first bowl 30*a*. Therefore, the first handle 56*a* can be readily disconnected from the first valve 18*a* and the first bowl 30*a*, for example, for cleaning.

The second handle 56*b* is slidably attachable to the second bowl 30*b* in exactly the same manner as the first handle 56*a*. Furthermore, regardless of whether the handles 56*a*, 56*b* are attached, the first and second bowls 30*a*, 30*b* are still removable from the lower housing 20 in exactly the same manner as described above.

Figure 7:
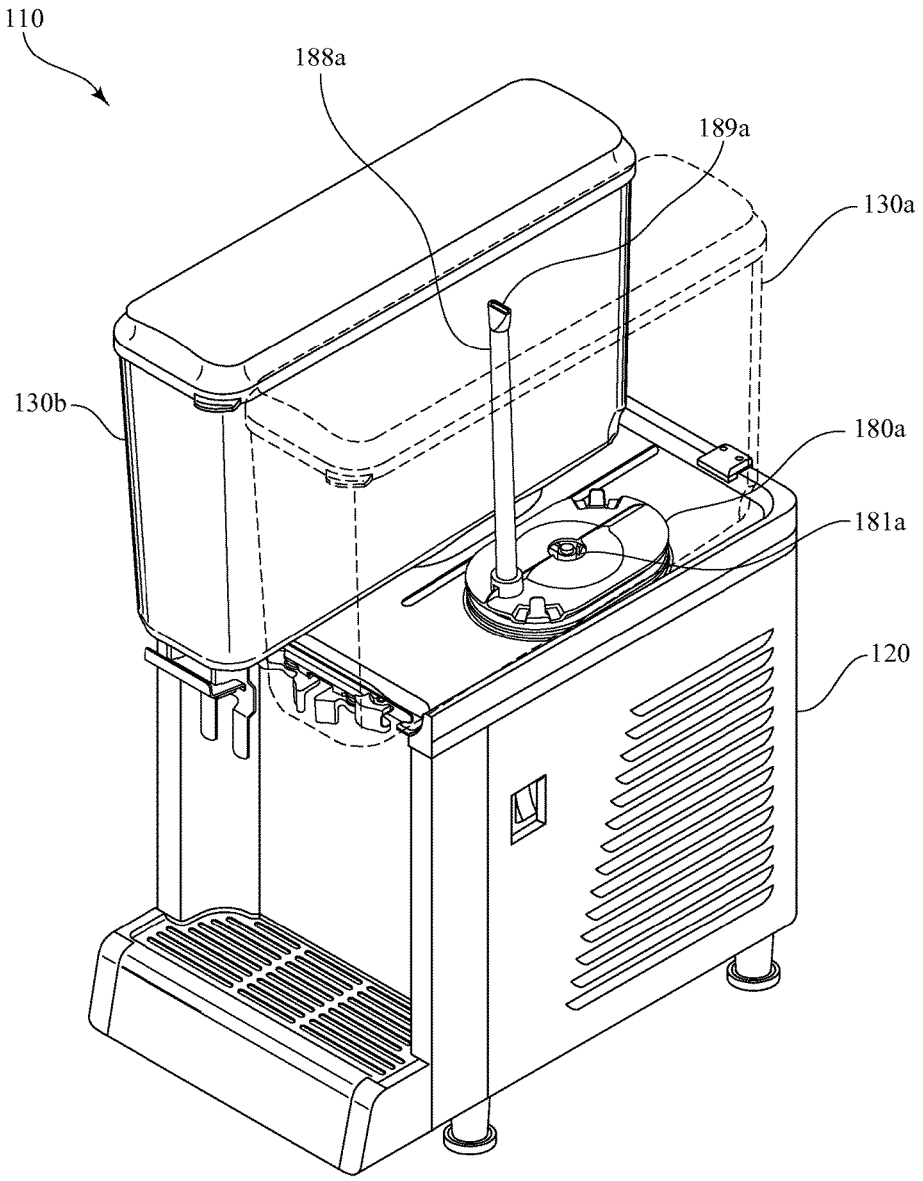
FIG. 7 is a front perspective view of another exemplary chilled beverage dispenser made in accordance with the present invention, with a first bowl and dispensing assembly in dashed lines to show an impeller cover and spray tube installed within the first bowl.
Figure 8:
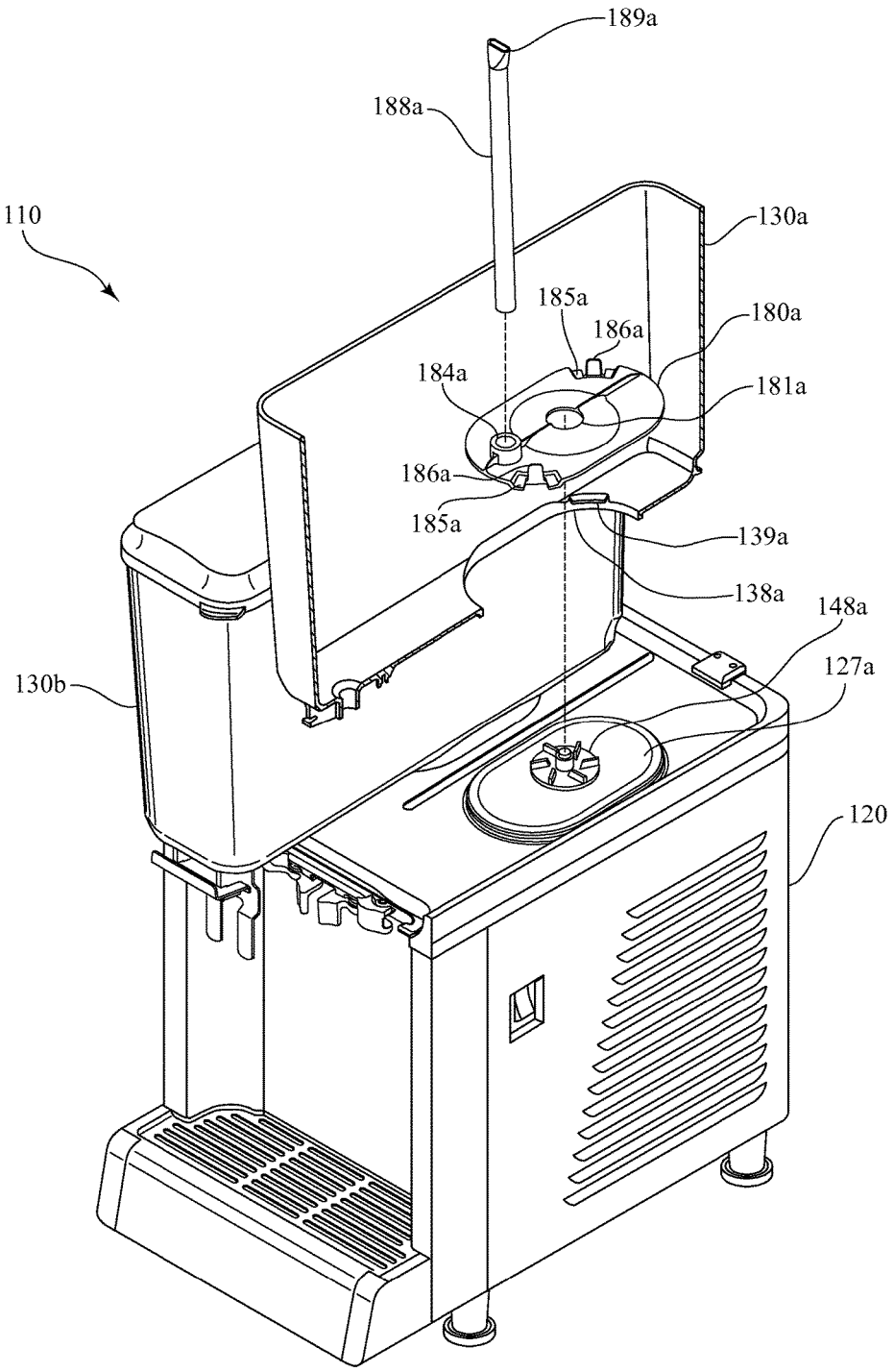
FIG. 8 is an exploded view of the exemplary chilled beverage dispenser of FIG. 7, with a first bowl partially cut away to show the interior of the first bowl.

Referring now to FIGS. 7-8, in another exemplary embodiment of the present invention, a chilled beverage dispenser 110 is substantially identical to the chilled beverage dispenser 10 described above with reference to FIGS. 1-6, but additionally has an agitator and spray unit comprised of a removable impeller cover and a spray tube for use within each bowl 130*a*, 130*b*. Specifically, like the chilled beverage dispenser 10 described above with reference to FIGS. 1-6, the chilled beverage dispenser 110 shown in FIGS. 7 and 8 has a first impeller 148*a* positioned adjacent to a first heat exchange surface 127*a* which rotates in order to circulate the beverage within a first bowl 130*a* to more uniformly cool the beverage stored in the first bowl 130*a*. However, unlike the chilled beverage dispenser 10 described above with reference to FIGS. 1-7, the chilled beverage dispenser 110 shown in FIGS. 7 and 8 further includes a first impeller cover 180*a* and a first spray tube 188*a*.

Referring still to FIGS. 7-8, the first impeller cover 180*a* is constructed and configured to be placed over the first impeller 148*a*, with the periphery of the first impeller cover 180*a* effectively coextensive with the periphery of the first heat exchange surface 127*a*. The first impeller cover 180*a* is not attached to the first heat exchange surface 127*a*, but rather it is attached to the first bowl 130*a*. Advantageously, the first bowl 130*a* of the chilled beverage dispenser 110 shown in FIGS. 7 and 8 thus is still removable from the lower housing 120 in the manner described above with reference to FIGS. 1-6, regardless of whether the first impeller cover 180 is attached to the first bowl 130*a*.

Due to the installation of such a first impeller cover 180*a* and first spray tube 188*a*, rather than merely just circulating the beverage within a first bowl 130*a*, the first impeller 148*a* draws the beverage into an intake hole 181*a* in the first impeller cover 180*a* and then pushes the beverage out of a nozzle 189*a* at the top of the first spray tube 188*a*, thus creating a visually appealing display in addition to circulating the beverage. Of course, other mixing and circulation mechanisms, such as a pump, could also be used in the exemplary chilled beverage dispenser 110 without departing from the spirit and scope of the present invention.

Figure 9:
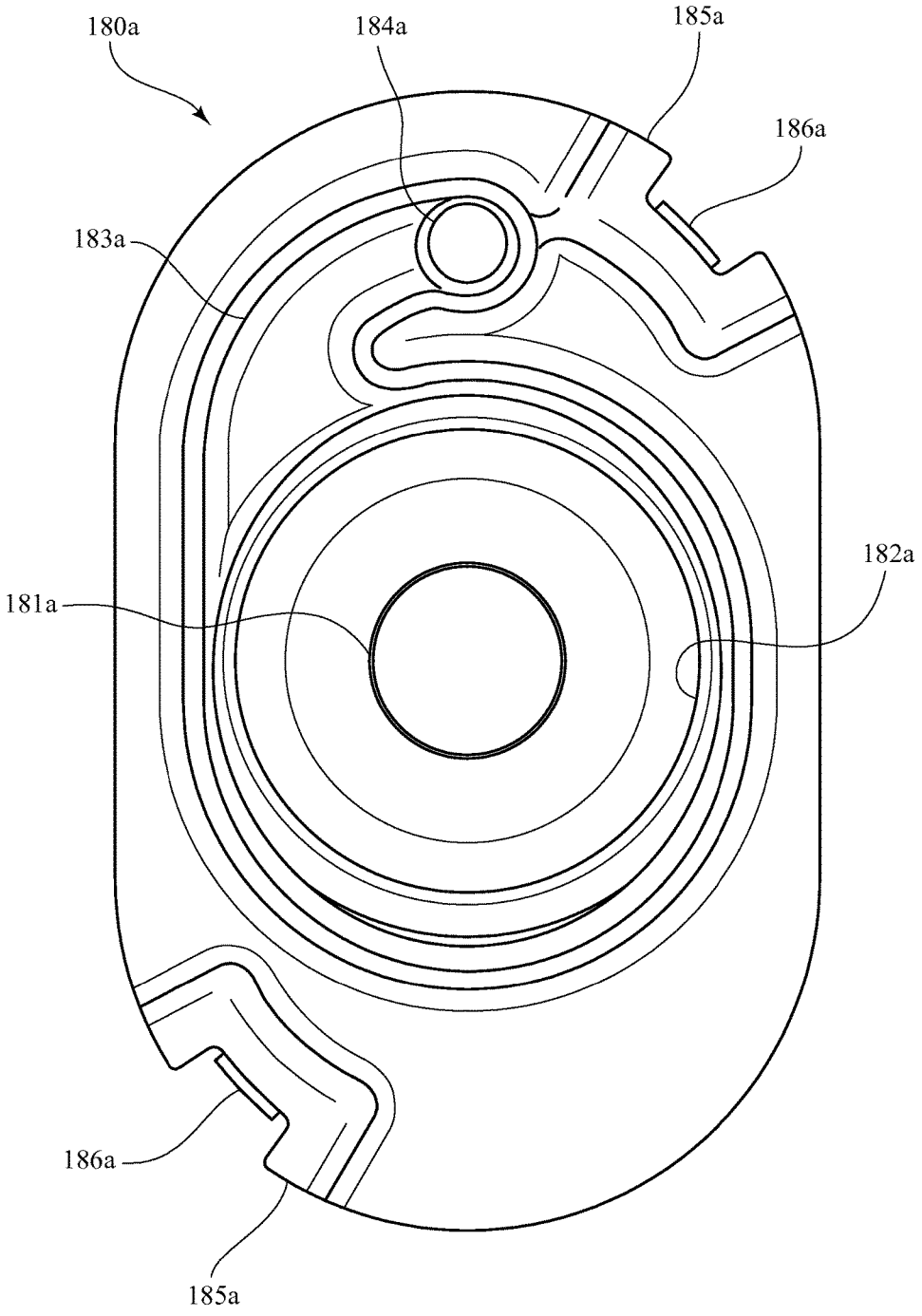
FIG. 9 is a bottom plan view of the impeller cover of FIG. 7.

FIG. 9 is a bottom plan view of the impeller cover used in the exemplary chilled beverage dispenser of FIGS. 7-8. As shown, the first impeller cover 180*a* defines a substantially circular cavity 182*a* which, when the first impeller cover 180*a* is attached, is above the first heat exchange surface 127*a* and contains the first impeller 148*a* (FIG. 8). The intake hole 181*a* is positioned at the center of the cavity 182*a* above the first impeller 148*a*, and a flow channel 183*a* is in fluid communication with and extends away from the cavity 182*a*, terminating in an outlet hole 184*a*. The first spray tube 188*a* is then connected to and is in fluid communication with this outlet hole 184*a*.

Referring once again to FIG. 8, in this exemplary embodiment, the first bowl 130*a* includes one or more inwardly projecting tabs 139*a* (only one is shown in FIG. 8) which are positioned inside the first bowl 130*a* around the opening 138*a* defined through the bottom surface of the first bowl 130*a*. As perhaps best shown in FIG. 9, the first impeller cover 180*a* has matching indentations 185*a* (two shown in FIG. 9) which are configured to engage the tabs 139*a* of the first bowl 130*a* in an interference fit. Vertical grips 186*a* are further included on the first impeller cover 180*a* adjacent to the indentations 185*a* in order to assist in the removal of the first impeller cover 180*a* from the first bowl 130*a*. As such, the first impeller cover 180*a* and the first spray tube 188*a* can also be readily removed from the first bowl 130*a* if the vertical spray functionality is not needed or for cleaning.

It should be understood that a second impeller, second impeller cover, and second spray tube could be installed in the second bowl 130*b* and would operate in exactly the same manner as described above.

Figure 10:
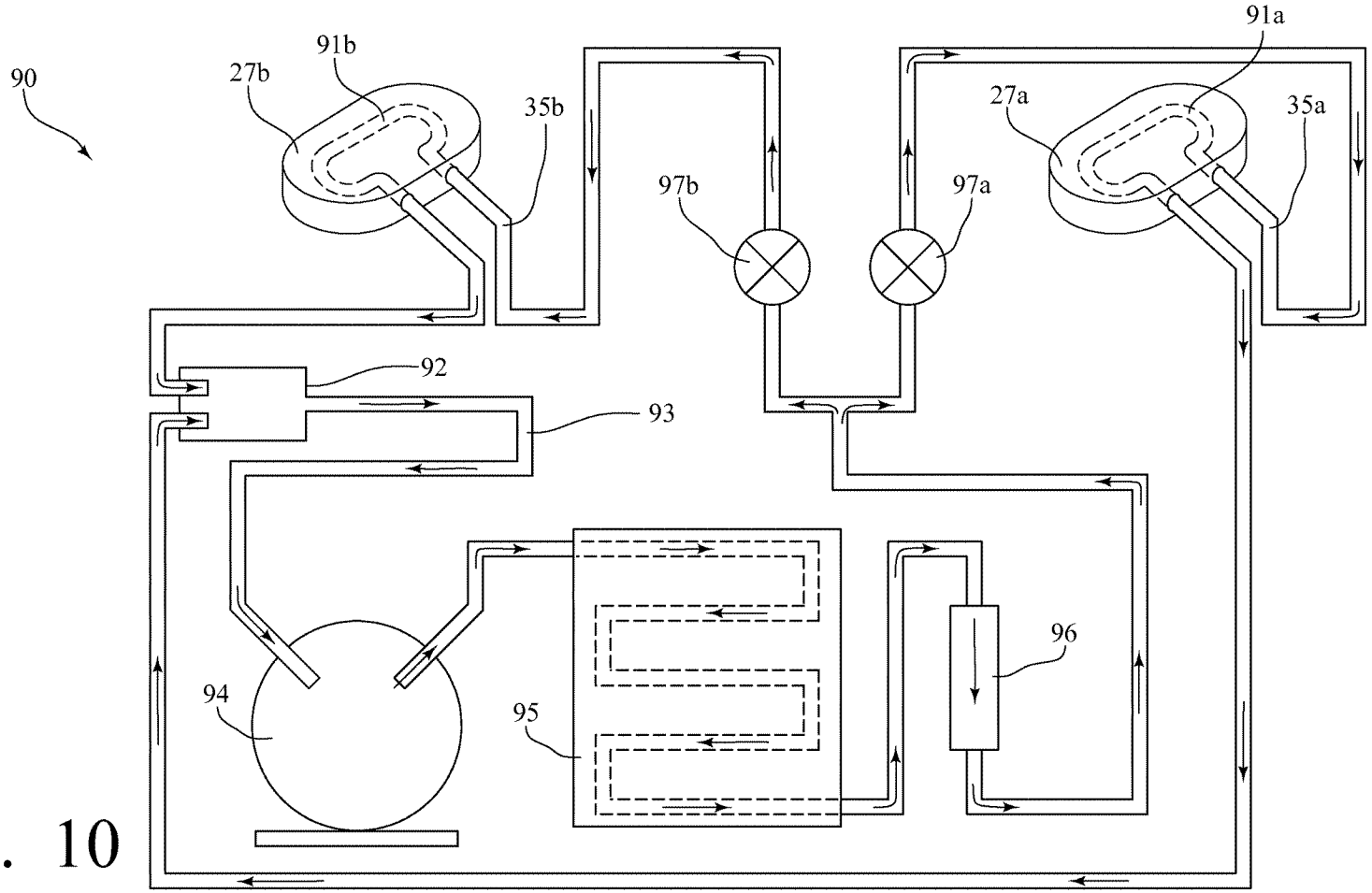
FIG. 10 is a schematic view of the cooling system used in the exemplary beverage dispenser of FIGS. 1-6.

Finally, it should be recognized that both of the exemplary chilled beverage dispensers 10, 110 described above include a typical cooling system 90 to produce the necessary refrigeration circuit. For example, as shown in the schematic view of FIG. 10, in the chilled beverage dispenser 10 described above with reference to FIGS. 1-6, evaporator coils 91*a*, 91*b* are positioned within the heat exchange surfaces 27*a*, 27*b* and are in fluid communication with certain cooling components housed in a lower housing 20 of the chilled beverage dispenser 10. The cooling components may include a compressor 94, a condenser 95, a filter/dryer 96, an expansion valve 97*a*, 97*b* (or other refrigerant control device), a suction accumulator 92, and a suction line 93. As is common in such cooling systems, the compressor 94 compresses the cooling medium, preferably a refrigerant gas such as R404a (a commercially available hydrofluorocarbon refrigerant), to raise the temperature and stored energy of the cooling medium. Therefore, the cooling medium exits the compressor 94 and enters the condenser 95 as a hot, high pressure gas. In the condenser 95, the heat from the pressurization of the cooling medium is dissipated, and the cooling medium reverts to a liquid form, but remains at a high pressure. The cooling medium then passes through a filter drier 96, which is designed to filter out contaminants and dry the cooling medium to prevent ice formation. As it exits the filter drier 96, the cooling medium is separated into two streams, one associated with each heat exchange surface 27*a*, 27*b*. In each case, the cooling medium passes through an expansion valve 97*a*, 97*b*, each of which serves as a pressure-reducing device and meters the cooling medium into the evaporator coils 91*a*, 91*b* of the respective heat exchange surfaces 27*a*, 27*b*. Because of the pressure drop, the cooling medium evaporates, absorbing heat as it does so. By the time the cooling medium exits the evaporator coils 91*a*, 91*b*, returning to the compressor 94 through a suction accumulator 92 and associated suction line 93, it again is a cool, low-pressure gas.

One of ordinary skill in the art will recognize that additional embodiments are possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A chilled beverage dispenser, comprising:

a lower housing;

a bowl for storing a beverage and including a catch projecting downward from an exterior surface of the bowl, the bowl positioned on an upper surface of the lower housing;

a means for supplying a cooling medium to chill the beverage when stored in the bowl; and a locking member operably connected to the lower housing, the locking member mounted for rotational movement about a substantially vertical pivot axis between a first position and a second position, the locking member including a first arm extending outward from the pivot axis;

wherein, when the locking member is in the first position, the first arm engages the catch on the bowl.

2. The chilled beverage dispenser of claim 1, wherein the catch on the bowl comprises a shaft projecting outward from the bowl and terminating in an enlarged distal end, and wherein the first arm of the locking member terminates in a retaining portion that defines a lower surface and a central channel, such that, when the locking member is in the first position, the enlarged distal end of the catch is positioned adjacent to the lower surface defined by the retaining portion and the shaft of the catch extends through the central channel defined by the retaining portion.

3. The chilled beverage dispenser of claim 1, and further comprising a torsion spring that biases the locking member into the first position.

4. The chilled beverage dispenser of claim 1, wherein the locking member further includes a second arm extending outward from the pivot axis, the second arm having an engagement surface, and wherein, when a force is applied to the engagement surface, the locking member rotates from the first position to the second position.

5. The chilled beverage dispenser of claim 1, and further comprising:

a bracket operably connected to a rear portion of the lower housing;

wherein the bowl includes a flange extending outward therefrom; and wherein the flange engages the bracket when the bowl is positioned on the upper surface of the lower housing.

6. The chilled beverage dispenser of claim 1, and further comprising a dispensing assembly which includes:

a dispensing valve attached to a front portion of the bowl; and a handle;

wherein the handle is slidably removable from the front portion of the bowl; and wherein, upon pushing the handle, the dispensing valve is moved into an open position, such that the beverage is dispensed through the dispensing valve.

7. The chilled beverage dispenser of claim 6, wherein the bowl includes a cradle extending from a bottom surface of the bowl, and wherein the handle slidably engages the cradle.

8. The chilled beverage dispenser of claim 7, wherein the cradle comprises two support members, each of which extend from the bottom surface of the bowl and includes a lateral projection, and wherein the handle includes a horizontal plate, such that, when the handle slidably engages the cradle, the horizontal plate rests on the lateral projections of the two support members.

9. The chilled beverage dispenser of claim 8, wherein the handle pivots about a forward portion of the lateral projections of the two support members.

10. The chilled beverage dispenser of claim 9, wherein the horizontal plate defines a central slot which receives the dispensing valve, and wherein the dispensing valve includes a circumferential flange positioned above the horizontal plate when the dispensing valve is received in the central slot of the horizontal plate, such that, upon pushing the handle, the horizontal plate pushes upward on the circumferential flange, thereby moving the dispensing valve into the open position.

11. A chilled beverage dispenser, comprising:

a lower housing;

a bowl for storing a beverage, said bowl including a catch on an exterior surface of the bowl and a flange extending outward from a rear surface of the bowl, the bowl positioned on an upper surface of the lower housing;

a bracket operably connected to the lower housing, and configured to engage the flange when the bowl is positioned on the upper surface of the lower housing;

a means for supplying a cooling medium to chill the beverage when stored in the bowl; and a locking member mounted at a front portion of the chilled beverage dispenser, the locking member moveable between a first position and a second position;

wherein, when the locking member is in the first position, the locking member engages the catch on the bowl.

12. The chilled beverage dispenser of claim 11, wherein the catch on the bowl comprises a downwardly projecting shaft, and wherein the locking member includes a first arm that is shaped and configured to engage and retain the downwardly projecting shaft when the locking member is in the first position.

13. The chilled beverage dispenser of claim 12, wherein the locking member is mounted for rotational movement about a substantially vertical pivot axis between the first position and the second position.

14. The chilled beverage dispenser of claim 13, wherein the locking member further includes a second arm extending outward from the substantially vertical pivot axis, with said second arm having an engagement surface, such that, when a force is applied to the engagement surface, the locking member rotates from the first position to the second position.

15. The chilled beverage dispenser of claim 11, and further comprising a spring that biases the locking member into the first position.

16. A chilled beverage dispenser, comprising:

a lower housing having a front portion, a rear portion, and an upper surface;

a first bowl for storing a first beverage, the first bowl positioned on the upper surface of the lower housing, the first bowl including a first flange extending outward from a rear surface of the first bowl, and a first downwardly projecting shaft;

a second bowl for storing a second beverage, the second bowl positioned on the upper surface of the lower housing, the second bowl including a second flange extending outward from a rear surface of the second bowl, and a second downwardly projecting shaft;

a first bracket connected to the rear portion of the lower housing, and configured to engage the first flange of the first bowl when the first bowl is positioned on the upper surface of the lower housing;

a second bracket connected to the rear portion of the lower housing, and configured to engage the second flange of the second bowl when the second bowl is positioned on the upper surface of the lower housing;

a means for supplying a cooling medium to chill the first beverage when stored in the first bowl and to chill the second beverage when stored in the second bowl; and a locking assembly operably connected to the front portion of the lower housing, the locking assembly including a central member having a first end and a second end opposite the first end, a first locking member operably connected to the first end of the central member and moveable between a first position and a second position, and a second locking member operably connected to the second end of the central member and moveable between a first position and a second position, wherein, when the first locking member is in the first position, the first locking member engages the first downwardly projecting shaft of the first bowl, wherein when the second locking member is in the first position, the second locking member engages the second downwardly projecting shaft of the second bowl.

17. The chilled beverage dispenser of claim 16, wherein the locking assembly is operably connected to the lower housing by a quick-release fastener.

18. A chilled beverage dispenser, comprising:

a lower housing having an upper surface;

a heat exchange surface positioned on the upper surface of the lower housing;

a bowl for storing a beverage, the bowl defining an opening such that, when the bowl is positioned on the upper surface of the lower housing, the heat exchange surface is received within the opening;

a means for supplying a cooling medium to the heat exchange surface to chill the beverage when stored in the bowl;

an impeller which rotates adjacent to the heat exchange surface;

an impeller cover which covers the heat exchange surface and defines a cavity above the heat exchange surface in which the impeller is received; and a spray tube in fluid communication with the cavity defined by the impeller cover.

* * * * *